US008692221B2

(12) United States Patent
Ford

(10) Patent No.: US 8,692,221 B2
(45) Date of Patent: Apr. 8, 2014

(54) ACTIVE IDENTIFICATION PATCH

(71) Applicant: The Flewelling Ford Family Trust, Beaconsfield (CA)

(72) Inventor: Timothy D.F. Ford, Beaconsfield (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 0 days.

(21) Appl. No.: 13/866,234

(22) Filed: Apr. 19, 2013

(65) Prior Publication Data

US 2013/0277578 A1 Oct. 24, 2013

Related U.S. Application Data

(60) Provisional application No. 61/635,621, filed on Apr. 19, 2012.

(51) Int. Cl.
*H05B 3/26* (2006.01)

(52) U.S. Cl.
USPC ..... 250/504 R; 250/491.1; 250/492.1; 434/11

(58) Field of Classification Search
USPC ..... 250/491.1, 492.1, 504 R
See application file for complete search history.

(56) References Cited

U.S. PATENT DOCUMENTS 4,097,279 A * 6/1978 Whitehead ..... 430/39
4,432,630 A * 2/1984 Haas ..... 355/1
4,583,766 A * 4/1986 Wessel ..... 283/88
4,779,120 A * 10/1988 Haas ..... 355/40
5,326,265 A * 7/1994 Prevou ..... 434/11
5,947,369 A * 9/1999 Frommer et al. ..... 235/382
6,116,744 A 9/2000 Batterman
6,446,865 B1 * 9/2002 Holt et al. ..... 235/382
6,560,352 B2 * 5/2003 Rowe et al. ..... 382/115
7,048,183 B2 * 5/2006 Coughlin et al. ..... 235/382
7,264,169 B2 * 9/2007 Juds ..... 235/468
7,370,798 B2 * 5/2008 Juds ..... 235/462.01
7,661,600 B2 * 2/2010 Theodossiou et al. ..... 235/492
7,666,682 B2 * 2/2010 Armentrout et al. ..... 436/56
7,815,124 B2 * 10/2010 Schneck et al. ..... 235/491
7,890,158 B2 * 2/2011 Rowe et al. ..... 600/476
8,083,152 B2 * 12/2011 Theodossiou ..... 235/492
8,542,094 B2 * 9/2013 Talwerdi ..... 340/5.8
2006/0278718 A1 * 12/2006 Senter et al. ..... 235/491
2010/0259814 A1 * 10/2010 Boyer et al. ..... 359/359
2011/0167689 A1 * 7/2011 Ford ..... 40/542
2012/0218101 A1 * 8/2012 Ford ..... 340/539.12
2013/0027685 A1 * 1/2013 Rowe et al. ..... 356/51
2013/0277578 A1 * 10/2013 Ford ..... 250/504 R

* cited by examiner

*Primary Examiner* — David A Vanore
(74) *Attorney, Agent, or Firm* — Goudreau Gage Dubuc; Hugh Mansfield

(57) ABSTRACT

A device, system and method for identifying an object. The device comprises an identification badge comprising a surface at least partially reflective to infrared light and having an insignia thereon, and a source of infrared light co-located with the badge and comprising at least one infrared light emitting LED. The source and the badge are both secured to the object and the source is positioned relative to the badge such that the light emitted from the at least one infrared LED falls on the reflective surface.

18 Claims, 7 Drawing Sheets

Badge

Identification device

ACTIVE IDENTIFICATION PATCH

CROSS REFERENCE TO RELATED APPLICATIONS

This application claims benefit, under 35 U.S.C. §119(e), of U.S. provisional application Ser. No. 61/635,621, filed on Apr. 19, 2012. All documents above are incorporated herein in their entirety by reference.

FIELD OF THE INVENTION

The present invention relates to an identification patch for identifying an object. In particular, the present invention relates to an identification patch and co-located source of infrared illumination.

BACKGROUND OF THE INVENTION

Soldiers and the like are often identified using insignia which provides identification of rank, unit, country and the like. The prior art also reveals insignia which reflects infrared light or thermal radiation and which are more readily visible at night using an appropriate image intensifier or night vision device, especially when illuminated with an appropriate external source of infrared or thermal radiation. However, such sources are located at the image intensifier or night vision device and therefore must cover a large field of view and be relatively powerful. This also means that the location of the image intensifier or night vision device is identifiable which may draw unwanted fire.

SUMMARY OF THE INVENTION

In order to address the above and other drawbacks there is provided a device for identifying an object. The device comprises a support adapted for attachment to the object, an identification badge mounted on the support and comprising a surface at least a portion of which is reflective to infrared light and having an insignia thereon, and a source of infrared light mounted on the support and comprising at least one infrared light emitting LED. The source is directed towards the badge such that the infrared light emitted from the at least one infrared LED falls on the reflective surface.

There is also disclosed a system for identifying an object. The system comprises an identification badge comprising a surface at least a portion of which is reflective to infrared light and having an insignia thereon, and a source of infrared light co-located with the badge and comprising at least one infrared light emitting LED. The source and the badge are both secured to the object and further wherein the source is positioned relative to the badge such that the light emitted from the at least one infrared LED falls on the reflective surface.

Additionally, there is provided a method of identifying an object. The method comprises providing an identification badge comprising a surface at least a portion of which is reflective to infrared light and having an insignia thereon, attaching a source of infrared light comprising at least one infrared LED and the badge to the object, and directing the source towards the badge such that the light emitted from the at least one infrared LED falls on the surface.

DETAILED DESCRIPTION OF THE ILLUSTRATIVE EMBODIMENTS

Figure 1:
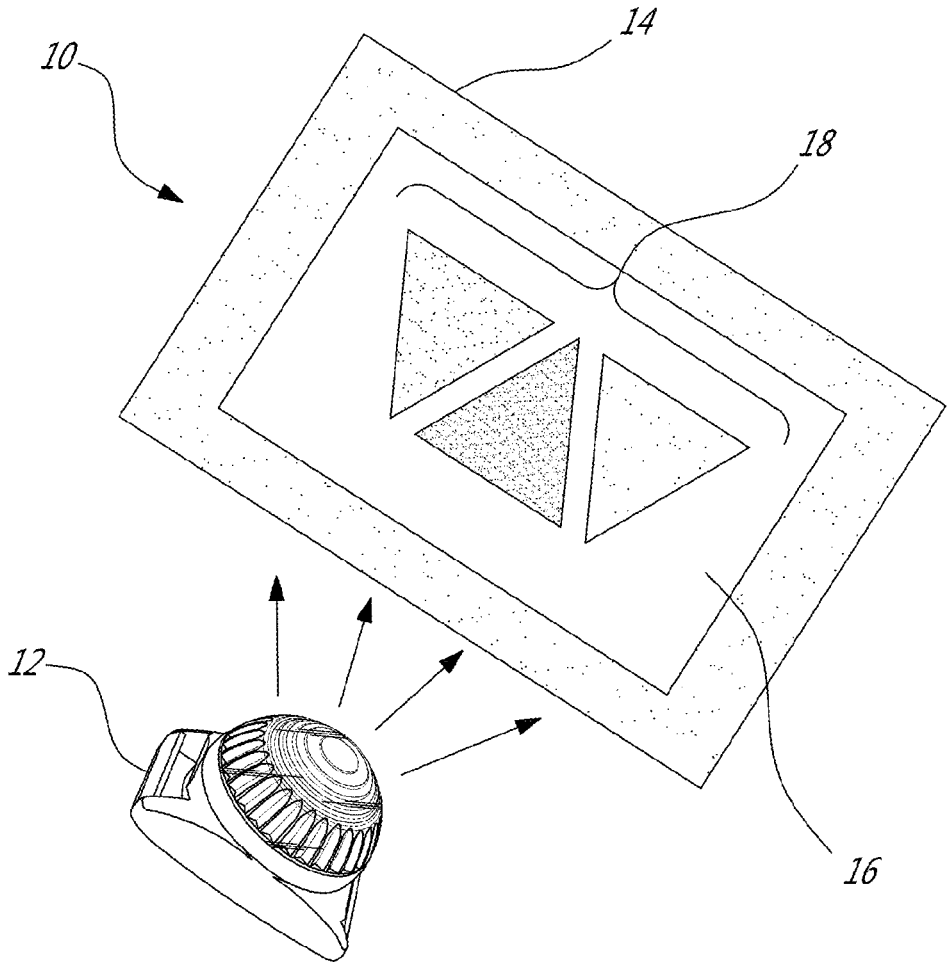
FIG. 1 is a plan view of an identification device in accordance with an illustrative embodiment of the present invention.

Referring now to FIG. 1, an identification device, general referred to using the reference numeral 10, and in accordance with an illustrative embodiment of the present invention will be described. The identification device 10 comprises a substantially flat identification patch or badge 12 co-located with a source of infrared light 14. The badge 12 and light source 14 are arranged such that at lease some of the infrared light emitted by the light source 14 falls on the surface 16 of the badge 12 and illuminates it. In a particular embodiment the badge 12 and light source 14 are arranged such that substantially all of the infrared light emitted by the light source 14 falls primarily upon the surface 16 of the badge 12. The surface 16 of the badge 12 is imprinted or otherwise treated to reflect the infrared light emitted by the light source, and comprises a distinguishable insignia 18, such as a flag, number, symbol, logo or the like. The badge 12 can be fabricated from materials that are reflective in the IR band or the thermal band or combinations thereof.

Still referring to FIG. 1, in a preferred embodiment the distinguishable insignia 18 is substantially invisible, particularly at night, when the device 12 is viewed with the naked eye, but is visible when viewed with an appropriate infra-red viewing device. Materials used to imprint or otherwise treat the badge to delineate, or render, the insignia include for example infra-red glow tape of the like, infrared paints such as fluorescent infrared paints, and other coatings and inks containing infrared reflective pigmentations and the like. In particular, the materials used to imprint or otherwise treat the badge 12 typically absorb much of the light in the visible range (having a wavelength of about 390 nm to 700 nm) but are highly reflective to infrared in at least a portion of the band between 850 nm and 1700 nm. The infrared light source 14 is also selected such that it operates within the range that the materials used to imprint the badge are reflective to infrared.

Figure 2A:
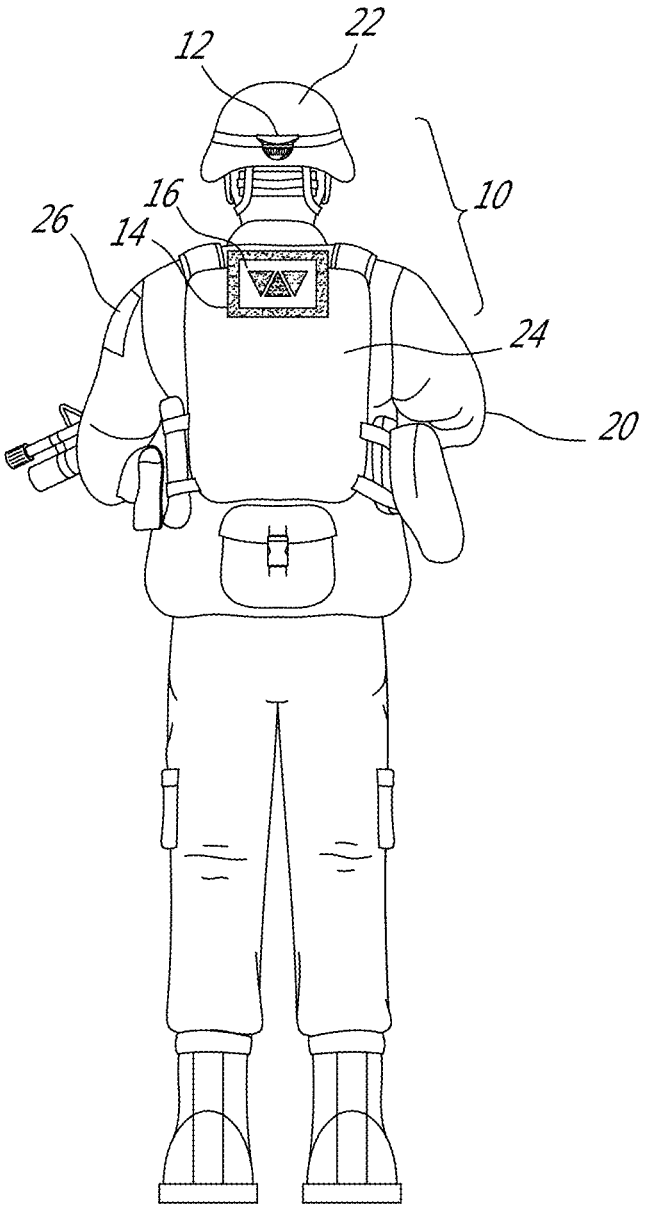
FIG. 2A is a back view of a soldier equipped with the device of FIG. 1.

Referring now to FIG. 2A, in an illustrative embodiment, the device 10 is positioned on a person (or object) to be identified, such as a solider 20. In this regard the light source 14 is fixed to the helmet 22 of the solider 20 and the badge 12 affixed to the back 24 of the solider, for example on the top of a backpack or the like (not shown). The light source 14 is directed towards the badge 12 such that the light emitted by the light source 14 falls on the surface 16 of the badge 12.

Note that although the badge 12 is shown affixed to the back, other regions of the soldier 20, for example the shoulder 26, may also prove suitable with appropriate modifications to the position of the light source 14.

Figure 2B:
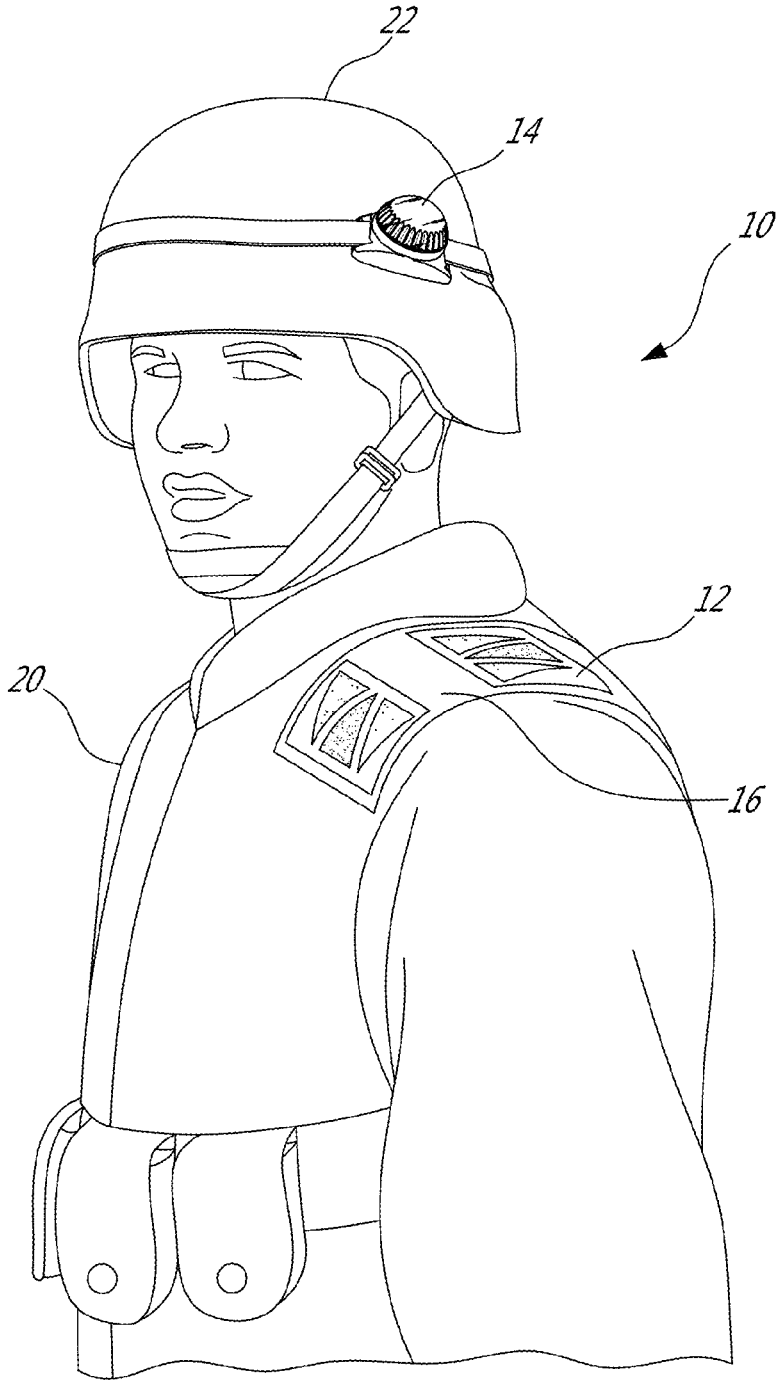
FIG. 2B is a front right view of a soldier equipped with the device of FIG. 1 in accordance with an alternative illustrative embodiment of the present invention.

Referring now to FIG. 2B, in an alternative illustrative embodiment, the device 10 is adapted for wrapping around the shoulder of the soldier 20. The light source 14 is fixed to the side of the helmet 22 of the solider 20 and the badge 12 is wrapped over the shoulder of the solider 20. The light source 14 is directed towards the badge 12 such that the light emitted by the light source 14 falls on all surfaces 16 of the badge 12. In this manner the badge 12 can be seen from the front and back as well as above.

Figure 2C:
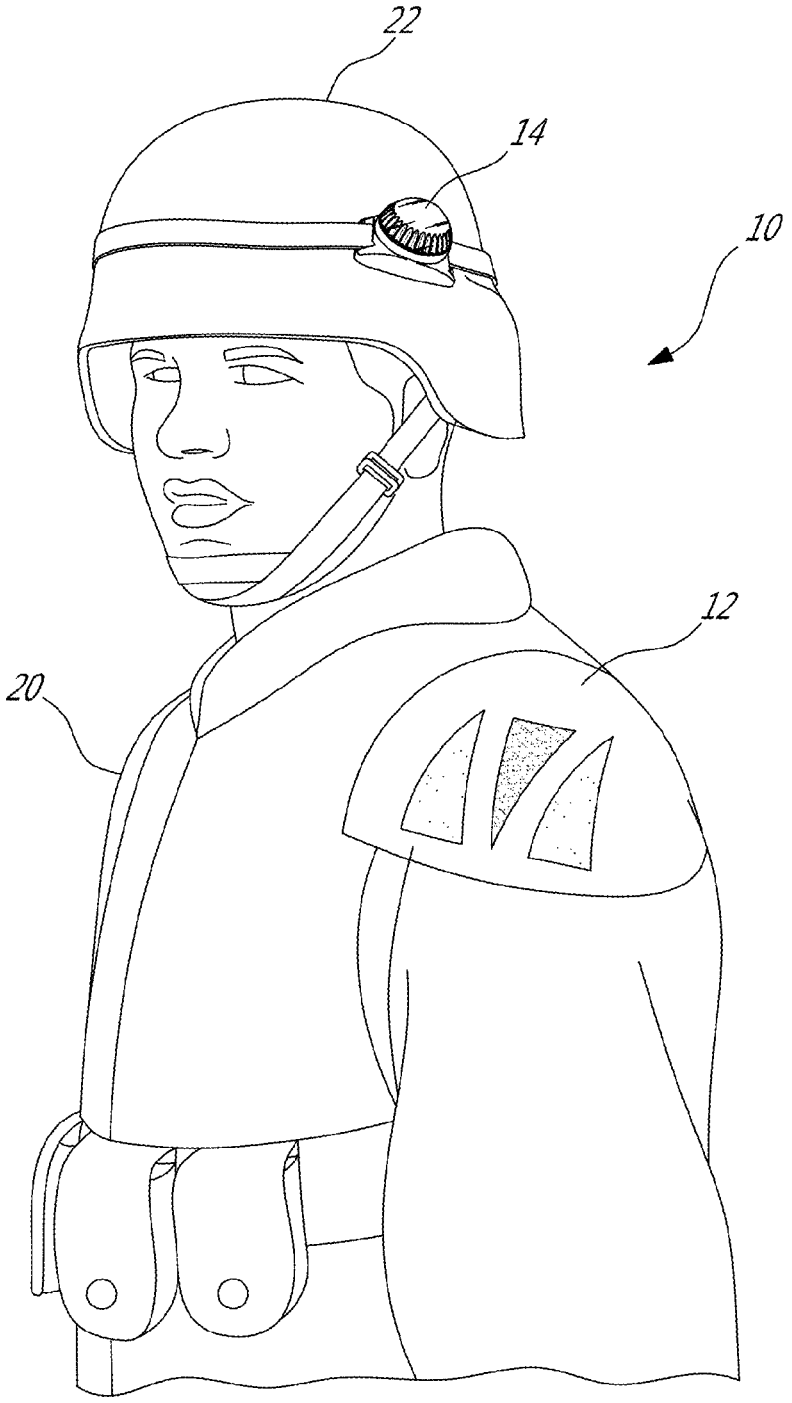
FIG. 2C is a front right view of a soldier equipped with the device of FIG. 1 in accordance with a second alternative illustrative embodiment of the present invention.

Referring to FIG. 2C, in a second alternative embodiment, the badge 12 can be moulded or shaped such that it is three dimensional and raised and adapted to be attached to the soldier's shoulder as an epaulette or the like.

Figure 3:
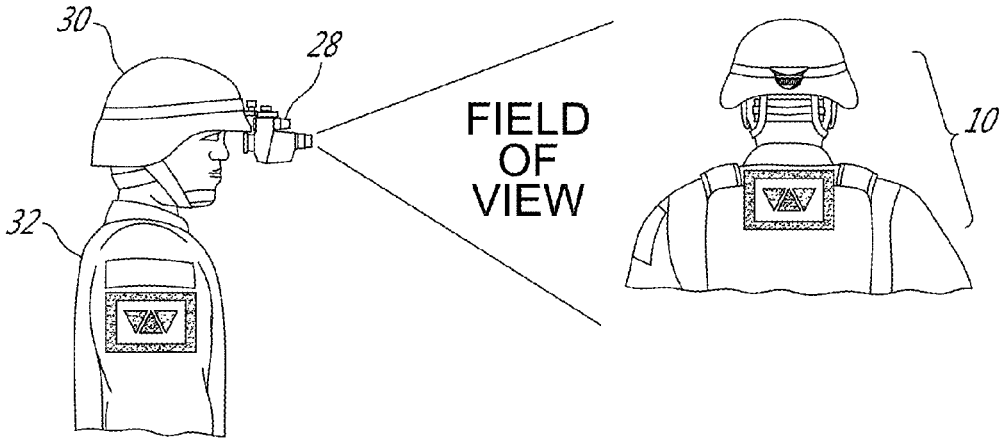
FIG. 3 is a descriptive diagram showing the use of the device of FIG. 1 together with a night vision device.

Referring now to FIG. 3, the identification device 10 is foreseen for viewing through night vision equipment 28 or the like which is sensitive to infrared light. Illustratively, a portable night vision equipment 28 is shown attached to the helmet 30 of a viewing solider 32.

Figure 4A:
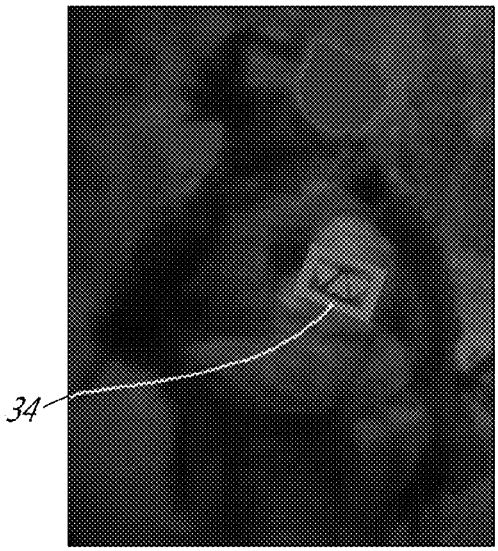
FIGS. 4A and 4B provide images of a solider viewed through a night vision device respectively of a conventional identification badge and the identification device of the present invention.
Figure 4B:
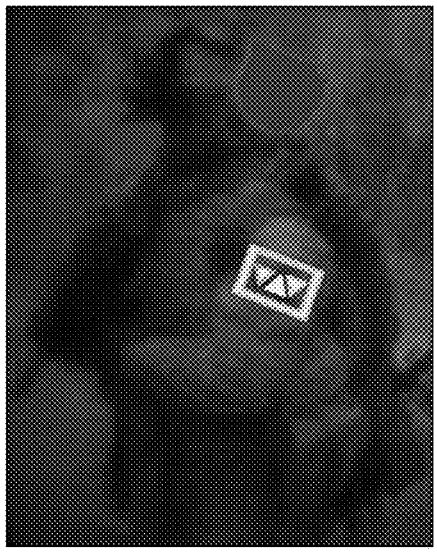

Referring now to FIGS. 4A and 4B in addition to FIG. 3, by combining a localized light source 14 with the badge 12, the visibility of the badge 12 when viewed through an infrared night vision equipment is greatly augmented (FIG. 4B) than when a conventional badge 34 without co-located light source. This greatly improves the positive identification of the badge 12, thereby reducing the possibility that the soldier 20 is misidentified and injured or killed by friendly fire.

Figure 5:
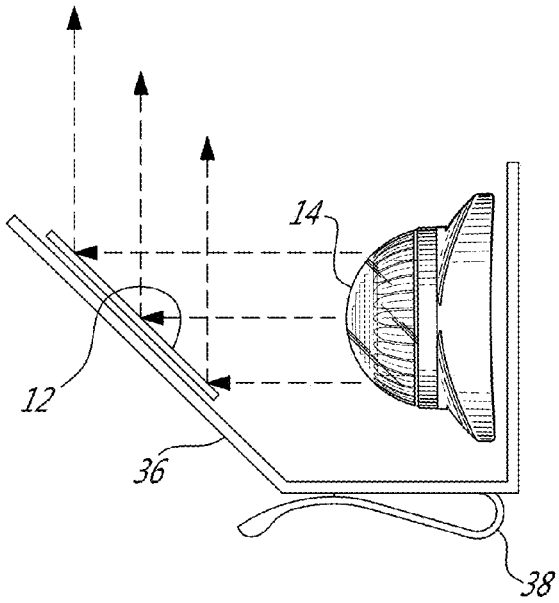
FIG. 5 provides a side plan view of an identification device in accordance with a third alternative illustrative embodiment of the present invention.

Referring now to FIG. 5, in a particular embodiment the positioning of the light source 14 relative to the reflective badge 12 can be better controlled by providing a rigid support 36 onto which the badge 12 and light source 14 can be mounted. The support 36 can include an attaching means such as a clip 38, magnet, Velcro, adhesive, strap or the like for attaching the support to the user's uniform, backpack or the like.

Figure 6A:
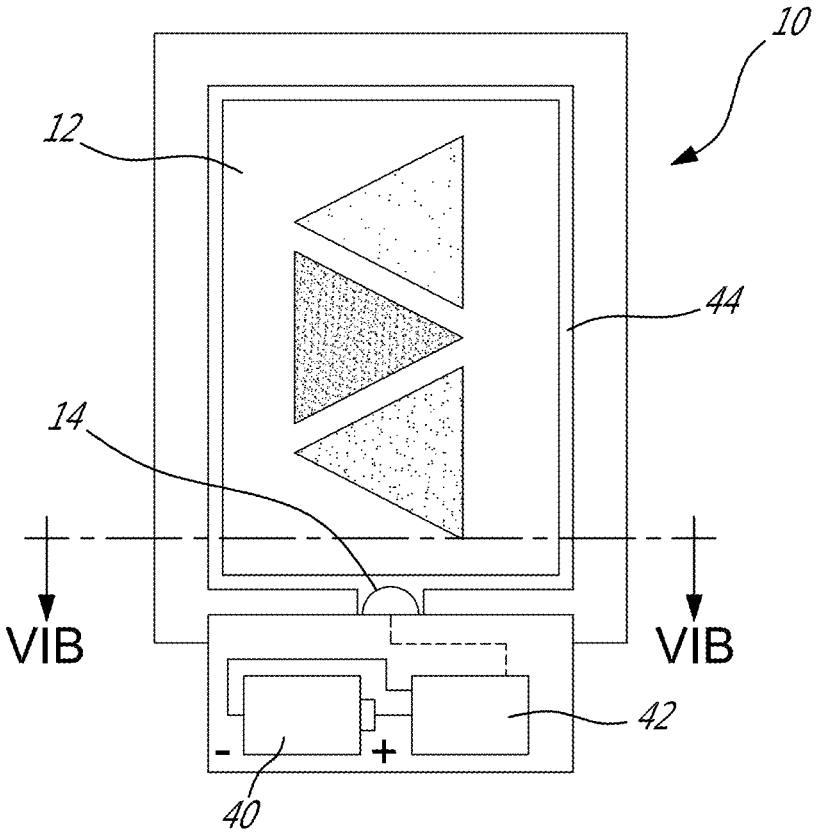
FIG. 6A provides a top plan view of an identification device in accordance with a forth alternative illustrative embodiment of the present invention.
Figure 6B:
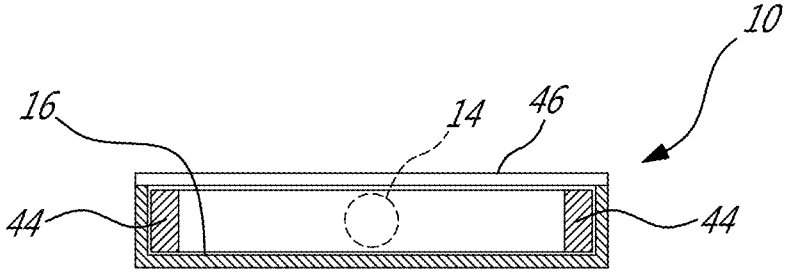
FIG. 6B provides a side cut-away view of the identification device of FIG. 6A along line VIB-VIB.

Referring now to FIGS. 6A and 6B, in a forth alternative embodiment the identification patch 10 comprises light source(s) 14, such as infrared LEDs or the like, which are integrated with the badge 12 and cast light on the badge surface 16 thereby improving its visibility. A power source 40 and electronics 42 are also provided to illuminate the light source(s) 14. In a particular embodiment, a light guiding or emitting material 44, such as an edge emitting optic fiber or light tube or the like, may be used to more evenly disburse the light emitted by the light source(s) 14 over the surface 16 of the identification patch 10. Additionally, the badge 12 may be overlaid with a transparent material 46 such as glass or plastic or the like.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

The invention claimed is:

1. A device for identifying an object, comprising:

a support adapted for attachment to the object;

an identification badge mounted on said support and comprising a surface at least a portion of which is reflective to infrared light and having an insignia thereon; and a source of infrared light mounted on said support and comprising at least one infrared light emitting LED;

wherein said source is directed towards said badge such that said infrared light emitted from said at least one infrared LED falls on said reflective surface.

2. The device of claim 1, wherein said support comprises a clip for attaching the device to the object.

3. The device of claim 1, wherein substantially all of the infrared light emitted by the light source falls upon the surface of the badge.

4. The device of claim 1, wherein said insignia is selected from a group consisting of a flag, number, symbol and logo or combinations thereof.

5. The device of claim 1, wherein said support is substantially flat, said identification badge is attached to said support and further wherein said light source further comprises a light guiding material arranged along at least one edge of said support, said light guide directing said infrared light onto said surface.

6. A system for identifying an object, comprising:

an identification badge comprising a surface at least a portion of which is reflective to infrared light and having an insignia thereon; and a source of infrared light co-located with said badge and comprising at least one infrared light emitting LED;

wherein said source and said badge are both secured to the object and further wherein said source is positioned relative to said badge such that said light emitted from said at least one infrared LED falls on said reflective surface.

7. The system of claim 6, wherein said badge and said source of light are in a fixed relationship.

8. The system of claim 7, further comprising a support onto which said badge and said light source are mounted.

9. The system of claim 8, wherein said support comprises a clip for attaching the device to the object.

10. The system of claim 8, wherein said support is substantially flat, said identification badge is attached to said support and further wherein said light source further comprises a light guiding material arranged along at least one edge of said support, said light guide directing said infrared light onto said surface.

11. The system of claim 10, wherein said light guiding material is selected from a group consisting of an edge emitting optic fiber and a light tube.

12. The system of claim 6, wherein said badge is fabricated from a pliable cloth like material and suitable for attachment to a uniform or the like.

13. The system of claim 6, wherein substantially all of the infrared light emitted by the light source falls upon the surface of the badge.

14. The system of claim 6, wherein said insignia is selected from a group consisting of a flag, number, symbol and logo or combinations thereof.

15. A method of identifying an object comprising:

providing an identification badge comprising a surface at least a portion of which is reflective to infrared light and having an insignia thereon;

attaching a source of infrared light comprising at least one infrared LED and said badge to said object; and directing said source towards said badge such that said light emitted from said at least one infrared LED falls on said surface.

16. The method of claim 15, wherein said source is directed such that substantially all of the light emitted from said at least one infrared LED falls on said reflective surface.

17. The method of claim 15, wherein said source and said badge are in a fixed relationship.

18. The method of claim 17, wherein said source and said badge are maintained in said fixed relationship by mounting source and said badge to a support.

* * * * *